United States Patent [19]

Baldwin

[11] 4,186,433

[45] Jan. 29, 1980

[54] LUMINAIRE

[75] Inventor: Samuel L. Baldwin, East Flat Rock, N.C.

[73] Assignee: General Electric Company, Schenectady, N.Y.

[21] Appl. No.: 879,189

[22] Filed: Feb. 21, 1978

[51] Int. Cl.[2] ..... F21S 3/02; F21V 3/02

[52] U.S. Cl. ..... 362/263; 362/300; 362/303; 362/307; 362/311; 362/327; 362/364; 362/404; 362/408

[58] Field of Search ..... 362/257, 263, 268, 290, 362/291, 299, 300, 307, 311, 327, 343, 346, 364, 297, 303, 404, 408

[56] References Cited

U.S. PATENT DOCUMENTS

| | | | |
|---|---|---|---|
| 1,302,492 | 5/1919 | Arenberg | 362/300 |
| 1,304,363 | 5/1919 | Peckham | 362/307 |
| 1,305,234 | 5/1919 | Pierce | 362/300 |
| 1,357,568 | 11/1920 | Jones | 362/346 |
| 1,361,587 | 12/1920 | Jones | 362/290 |
| 1,472,050 | 10/1923 | Curtis | 362/307 |
| 1,549,771 | 8/1925 | Hotchkin | 362/343 |
| 1,612,300 | 12/1926 | Manookin | 362/307 |
| 1,790,179 | 1/1931 | Symmes | 362/307 |
| 1,876,667 | 9/1932 | Gunnison | 362/346 |
| 2,022,264 | 11/1935 | Wiedenhoeft | 362/303 |
| 2,303,747 | 12/1942 | Kuhl | 362/408 |
| 2,675,466 | 4/1954 | Baker | 362/408 |
| 2,922,030 | 1/1960 | Bobrick | 362/364 |
| 3,370,165 | 2/1968 | Chan | 362/364 |
| 3,950,638 | 4/1976 | Kent et al. | 362/297 |

*Primary Examiner*—Howard A. Birmiel
*Attorney, Agent, or Firm*—Sidney Greenberg

[57] ABSTRACT

Indoor lighting fixture providing semi-indirect symmetrical light distribution. The fixture, which is adapted to be positioned adjacent the ceiling of the room comprises a high intensity gaseous discharge lamp mounted at its base on the ceiling and extending downwardly into a box-shaped reflector open at its top with reflective sides and a diffuser panel at its bottom. Positioned in the reflector and surrounding the lower portion of the lamp is a dish-shaped semi-transparent reflector which reflects a portion of the incident light toward the ceiling and transmits a portion of the light to the area below the fixture. The arrangement is such that direct and indirect light is distributed by the fixture while shielding the light source from direct view of the room occupants to avoid glare.

15 Claims, 3 Drawing Figures

LUMINAIRE

The present invention relates to luminaires, and more particularly concerns indoor lighting fixtures for semi-indirect light distribution without substantial glare.

With the advent of light sources having efficacies higher than fluorescent lamps, such as high pressure sodium vapor and metal halide (high intensity) gaseous discharge lamps (HID lamps), it is contemplated that such high intensity lamps will find substantially increased use for indoor applications such as in offices, classrooms and store merchandizing areas. There is an economic advantage in using especially the higher wattage lamps of this type, due to the greater efficiency, the reduced number of lighting fixtures required to illuminate a given area, and the consequent reduction in the time necessary for installation and maintenance of a lighting system comprising such fixtures. However, the brightness of the lighting fixture is usually too great when such higher wattage lamps are used in the conventional types of indoor luminaires.

It is an object of the invention to provide an improved indoor luminaire using a high intensity gaseous discharge lamp.

It is another object of the invention to provide a luminaire of the above type which provides substantially uniform semi-indirect symmetrical distribution of light.

Still another object of the invention is to provide a luminaire of the above type wherein the light source is substantially shielded from the observer to avoid glare.

Other objects and advantages will become apparent from the following description and the appended claims.

With the above objects in view, the present invention in one of its aspects relates to a luminaire adapted to be mounted adjacent the ceiling of a room for substantially uniform symmetrical semi-indirect lighting of the room comprising a ceiling panel, means for mounting a high intensity gaseous discharge lamp on the ceiling panel so as to extend downwardly therefrom, whereby direct light from the lamp incident on the ceiling panel is re-directed downwardly therefrom, a housing having a surrounding sidewall defining an open top and an open bottom, means for suspending the housing from the ceiling panel, the gaseous discharge lamp extending downwardly into the housing, concave means within the housing surrounding the lower portion of the gaseous discharge lamp for transmitting downwardly a portion of the light incident thereon from the lamp and reflecting the remainder of the incident light upwardly and outwardly of the housing for re-direction downwardly by the ceiling, and light diffusing closure means covering the open bottom of the housing, whereby direct and indirect light is substantially uniformly distributed by the luminaire into the room while shielding the light source from direct view of the room occupants to avoid glare.

The invention will be better understood from the following description taken in conjunction with the accompanying drawings, in which.

Figure 1:
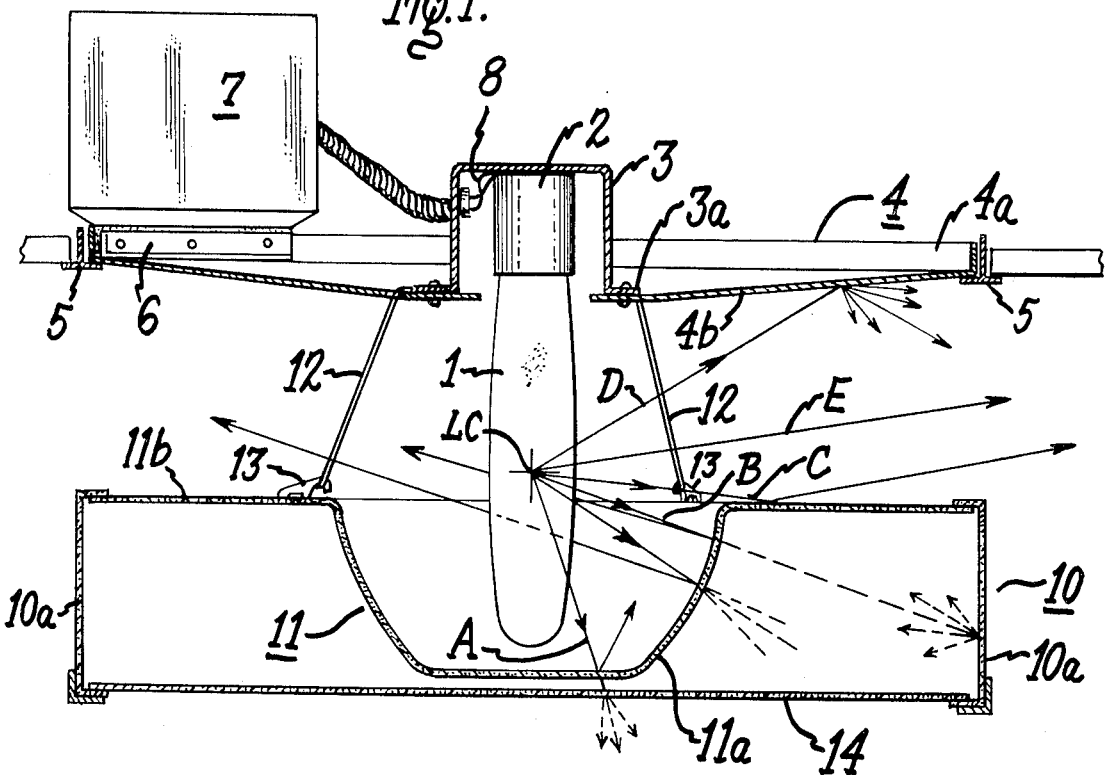
FIG. 1 is a somewhat diagrammatic side view of a luminaire embodying the invention, showing the path of light rays therein.

Referring now to the drawings, and particularly to FIG. 1, there is shown a ceiling mounted luminaire comprising lamp 1, typically a high intensity gaseous discharge lamp such as a metal halide lamp, removably mounted in socket 2 secured to cupola 3 which projects upwardly into lay-in ceiling panel 4 and is suitably secured thereto at its bottom flange 3*a*. Ceiling panel 4, which in the illustrated embodiment is square in form, is typically formed of sheet metal, e.g. aluminum or steel, having upstanding side flanges 4*a* and a centrally downwardly sloping bottom portion 4*b* having an outer light diffusing surface provided, for example, by a coat of flat white paint. Ceiling panel 4 is a so-called "lay-in panel" which rests at its margins on the bottom flanges of T-bars 5 of the ceiling grid support system. Secured to the upper side of ceiling panel 4 by means of bracket 6 is ballast housing 7 connected by electrical conductors 8 to lamp socket 2. As understood in the art, electrical operating components (not shown) such as a ballast transformer and capacitors are mounted within ballast housing 7 for operating lamp 1.

Housing 10, typically square in shape, is formed of opaque side walls 10*a* having a light diffusing coating such as flat white paint on their inner surfaces. Mounted within housing 10 is dish-shaped semi-transparent reflector 11 having a concave central portion 11*a* and a wide rim 11*b* extending horizontally around the opening of concave portion 11*a*. Housing 10 is suspended from ceiling panel 4 by circumferentially spaced hangers 12, typically three, which engage hooks 13 or the like secured to rim 11*b* of the semi-transparent reflector 11, the arrangement being such that lamp 1 extends vertically into the interior of housing 10 with its lower portion symmetrically surrounded by semi-transparent reflector 11 and with its light center LC located somewhat above the top of housing 10, as shown.

The open bottom of housing 10 is closed by light transmitting panel 14, which is typically of diffusing nature such as of a prismatic or pebbled form to scatter light so as to hide the interior of housing 10 while allowing passage of light.

The described arrangement is such that light emanating downwardly from lamp 1 and incident on semi-transparent reflector 11 is partially transmitted and partially reflected by the latter, as indicated by the arrows representing the light rays. Thus, light ray A incident on the bottom of semi-transparent reflector 11 passes in part downwardly through the latter and diffusing panel 14 as shown by the dashed arrows and in part is reflected upwardly as indicated by the solid-line arrow to be directed onto ceiling panel 4*b* for re-direction downwardly therefrom to provide indirect illumination. Light ray B incident on the side of semi-transparent reflector 11 similarly is partially reflected and partially transmitted by the latter, such that the reflected ray passes upwardly and outwardly of the fixture to be ultimately re-directed downwardly by the ceiling in the vicinity of the fixture, and the transmitted ray strikes the inner surface of side wall 10*a* for diffusion thereby in various directions as shown by the dashed arrows.

Light ray C incident on rim 11*b* of the semi-transparent reflector is for the most part reflected outwardly and upwardly therefrom to be ultimately re-directed downwardly by the ceiling, while a small portion thereof passes through semi-transparent reflector 11 for diffusion in various directions.

As seen in FIG. 1, light emanating upwardly from lamp 1, as represented by light ray D, strikes ceiling panel 4 and is re-directed therefrom in a diffused manner downwardly into the room. Other upward light beams from lamp 1 as represented by light ray E pass outwardly from the fixture to be re-directed downwardly by ceiling areas remote from the fixture.

In a preferred embodiment of the invention, about 30% of the light from lamp 1 is directed downwardly through the bottom of housing 10 and about 60–70% of the light is directed upwardly toward the ceiling for re-direction therefrom, thus providing both direct and indirect illumination of the room. The upwardly directed light not only contributes to efficient illumination of the work area in the room, but also markedly lessens the contrast of the fixture brightness with respect to the ceiling which otherwise would result in the absence of such upwardly directed light.

The transmittance of the material of semi-transparent reflector 11 determines to a large extent the proportion of direct light emanating from the fixture. For example, material of very white color and little transmittance would increase the proportion of indirect light and reduce the proportion of direct light, whereas a clear transparent material would have the opposite effect. In a typical embodiment of the invention, semi-transparent reflector 11 may be made of acrylic resin incorporating titanium oxide pigment in an amount producing preferably about 50% light transmission, or broadly in the range of about 30–70% light transmission, with the remainder of the incident light being reflected.

The described arrangement is such that light rays from the light center of lamp 1 are cut off by housing 10, as shown, for example by light ray C, so that the light source is largely shielded from direct view of the room occupants to avoid glare in the eyes of the latter. At the same time, the fixture provides symmetrical semi-indirect light distribution for efficiently illuminating the entire room.

To reduce shadowing effects, hangers 12 may be of serpentine form rather than linear as shown.

While housing 10 has been described as square, it may be of other shapes such as circular or any of various polygonal forms, if desired.

The angle at which ceiling panel **4*b*** converges toward its central opening may be different from that shown, depending on the desired angle at which the incident light is to be reflected into the room.

Figure 2:
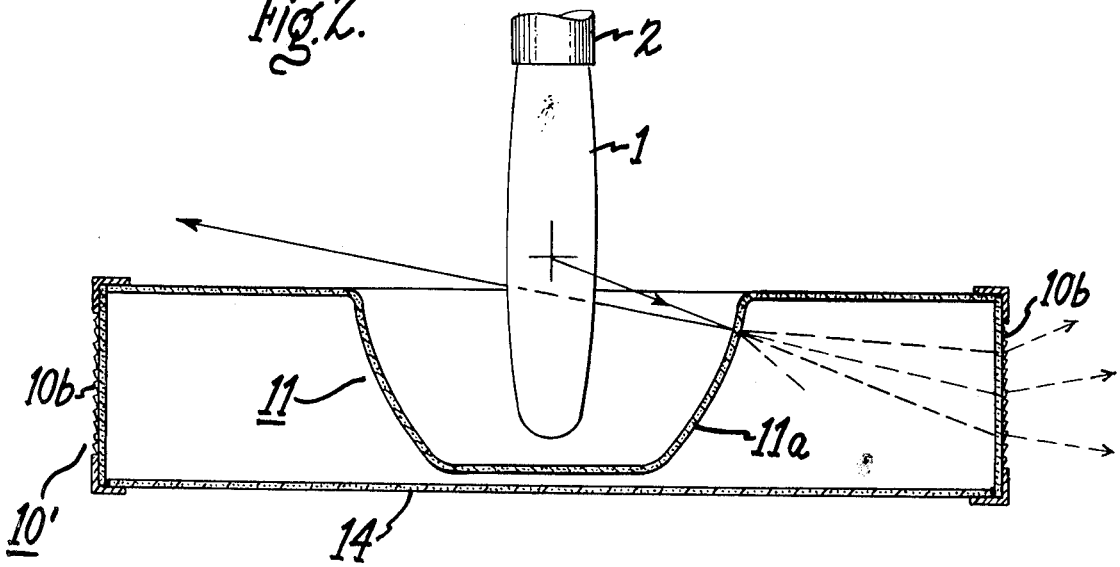
FIG. 2 is a similar view of a modification of the FIG. 1 luminaire.

FIG. 2 shows a modification of the FIG. 1 fixture wherein housing 10' has transparent prismatic side walls **10*b* for transmitting substantially all the light incident thereon. Preferably, lifting prisms are employed for the side walls in order to re-direct the incident light generally upwardly and outwardly, as shown by the dashed arrows representing light rays passing through side walls 10*b*. Such emanating light rays should be directed at least at a sufficient vertical angle to avoid glare in the eyes of an observer in a normal position in the room. The FIG. 2 embodiment is preferably used where greater efficiency of illumination is sought, and also where it is desired to illuminate the sides of housing 10' for aesthetic reasons. Such an embodiment may, for example, be found appropriate for installation in a coffer of the ceiling to avoid substantial shadowing effects such as would occur with the use of the FIG. 1 embodiment in a ceiling coffer. The FIG. 2** embodiment in such an installation would provide for light transmitted through the prismatic sides to be directed to the sloped sides of the coffer (not shown).

Figure 3:
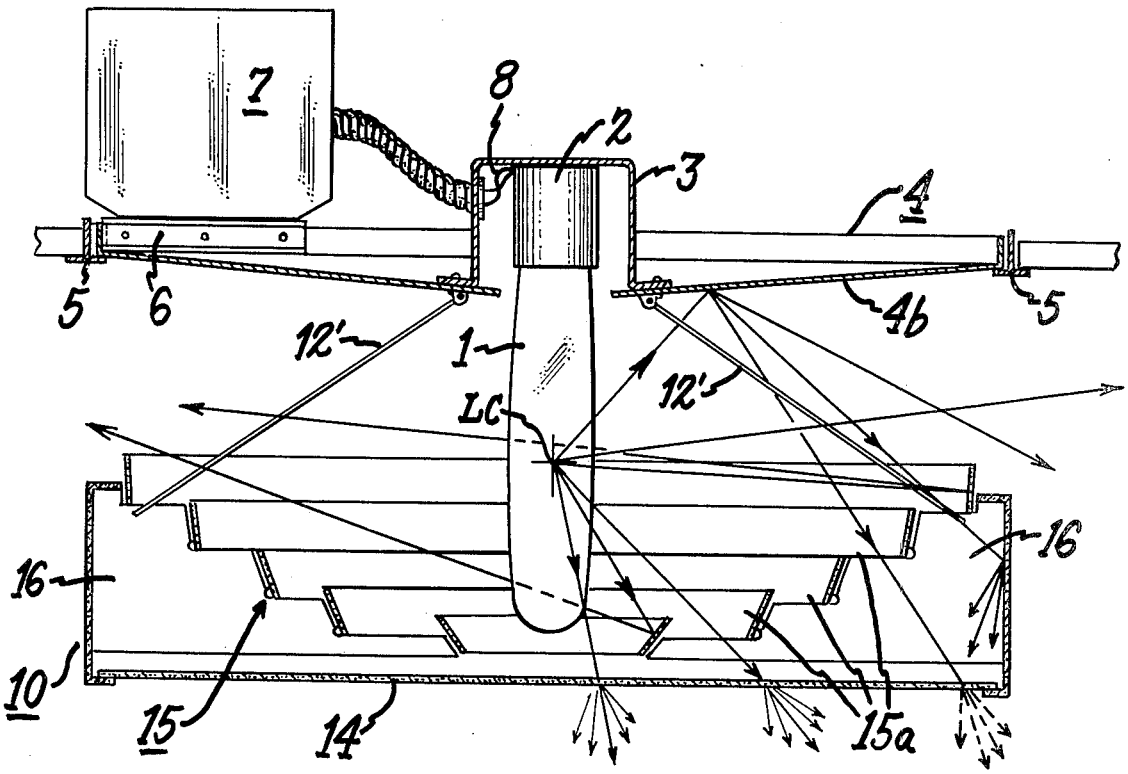
FIG. 3 is a similar view of another embodiment of the luminaire in accordance with the invention.

FIG. 3 shows another embodiment of the invention wherein a multi-tiered reflector 15 is employed in place of semi-transparent reflector 11. Reflector 15 comprises a plurality of co-axial annular reflectors **15*a*, such as polished aluminum, of different diameters arranged in vertically offset, overlapping relation from top to bottom in order of decreasing diameter. Reflectors 15*a* are mounted in stepped supports 16 secured, for example, at the corners of housing 10 such that the annular reflectors 15*a* are spaced radially from each other. Hangers 12' connected at their bottom ends to supports 16 suspend housing 10 from ceiling panel 4. The various ray diagrams in FIG. 3 show the manner in which both direct and indirect light emanates from the fixture, it being noted that certain of the light rays directed into reflector 15 pass between adjacent annular reflectors 15*a* and strike bottom panel 14 and the diffusing wall of housing 10, while other rays are reflected upwardly and outwardly by various ones of the annular reflectors. Thus, reflector 15 is in a sense a semi-transparent reflector and the expression "semi-transparent" as used herein is intended to include in its meaning such a reflector device or its equivalent. The FIG. 3** embodiment accordingly achieves by a different structure the type of semi-indirect illumination produced by the previously described embodiments.

Another example of such a semi-transparent reflector structure would be a perforated aluminum reflector (not shown) of substantially the shape of reflector 11 shown in FIG. 1, whereby some of the incident light would pass through the perforations while the remaining light would be reflected by the solid portions of the aluminum reflector.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire adapted to be mounted adjacent the ceiling of a room for substantially uniform symmetrical semi-indirect lighting of the room comprising a ceiling panel, a high intensity gaseous discharge lamp mounted on said ceiling panel so as to extend downwardly therefrom, a housing having a surrounding side wall defining an open top and an open bottom, means for suspending said housing from said ceiling panel, said gaseous discharge lamp extending downwardly into said housing, concave means within said housing surrounding the lower portion of said gaseous discharge lamp for transmitting downwardly a portion of the light incident thereon from said lamp and reflecting the remainder of said incident light upwardly and outwardly of said housing for re-direction downwardly by the ceiling, and light diffusing closure means covering the open bottom of said housing, said ceiling panel being arranged for receiving direct light from said lamp and re-directing the same downwardly and outwardly from the luminaire, whereby direct and indirect light is substantially uniformly distributed by the luminaire into the room while shielding the light source from direct view of the room occupants to avoid glare.

2. A luminaire as defined in claim 1, said concave means comprising a semitransparent reflector having a central dished portion symmetrically surrounding the lower portion of said lamp and a rim portion extending outwardly a substantial distance from said central dished portion, said rim portion secured at its outer edge to said housing.

3. A luminaire as defined in claim 2, said suspending means comprising a plurality of spaced hangers removably attached to said rim portion of said semitransparent reflector.

4. A luminaire as defined in claim 1, said side wall of said housing being opaque and having an inner light diffusing reflective surface.

5. A luminaire as defined in claim 4, said gaseous discharge lamp being elongated and having a base at its upper end removably mounted on said ceiling panel.

6. A luminaire as defined in claim 5, said lamp having a light center and arranged with its light center above said housing.

7. A luminaire as defined in claim 1, said ceiling panel sloping downwardly toward its cener for directing light from said lamp downwardly and outwardly therefrom.

8. A luminaire as defined in claim 1, wherein ballast means for operating said lamp are mounted on the upper side of said ceiling panel.

9. A luminaire as defined in claim 3 wherein said semi-transparent reflector transmits about 30–70% of the light incident thereon and reflects substantially the remainder of said light.

10. A luminaire as defined in claim 1, said housing extending laterally a sufficient distance from said lamp to intercept a substantial amount of downwardly directed light from said lamp to reduce glare therefrom.

11. A luminaire as defined in claim 1, said housing side wall being formed of light transmitting material.

12. A luminaire as defined in claim 11, said housing side wall comprising prisms for lifting beams incident thereon from said lamp.

13. A luminaire as defined in claim 1, wherein said concave means comprises reflecting surfaces for reflecting a portion of the incident light and defining openings for transmitting the remaining incident light.

14. A luminaire as defined in claim 13, wherein said concave means comprises a plurality of annular reflectors in vertically offset, overlapping, radially spaced relation.

15. A luminaire as defined in claim 14, said annular reflectors being of different diameters and arranged from top to bottom in order of decreasing diameter.

* * * * *